United States Patent [19]

Schmid

[11] Patent Number: 4,717,502

[45] Date of Patent: Jan. 5, 1988

[54] AQUEOUS OPTICAL BRIGHTENER COMPOSITIONS

[75] Inventor: Hans-Rudolf Schmid, Riehen, Switzerland

[73] Assignee: Sandoz Ltd., Basel, Switzerland

[21] Appl. No.: 820,043

[22] Filed: Jan. 21, 1986

[30] Foreign Application Priority Data

Jan. 23, 1985 [DE] Fed. Rep. of Germany ..... 3502038

[51] Int. Cl.[4] ..... C09K 11/06

[52] U.S. Cl. ..... 252/301.23; 252/301.26; 252/301.32; 252/543; 427/391; 524/522; 524/523; 524/556; 524/560; 524/575

[58] Field of Search ..... 252/301.23, 301.21, 252/301.26, 301.32, 543; 524/556, 522, 523, 560, 575

[56] References Cited

U.S. PATENT DOCUMENTS

| | | | |
|---|---|---|---|
| 3,239,513 | 3/1966 | Hausermann | 544/193.2 |
| 3,360,479 | 12/1967 | Hausermann | 252/301.2 |
| 3,928,329 | 12/1975 | Fleck et al. | 548/255 X |
| 3,970,647 | 7/1976 | Blazer et al. | 427/158 X |
| 4,025,507 | 5/1977 | Fleck et al. | 427/158 X |
| 4,252,604 | 2/1981 | Fleck et al. | 427/158 X |

FOREIGN PATENT DOCUMENTS

| | | |
|---|---|---|
| 1329353 | 10/1963 | France . |
| 0930393 | 7/1963 | United Kingdom . |
| 1294173 | 10/1972 | United Kingdom . |
| 1391593 | 4/1975 | United Kingdom . |

*Primary Examiner*—Thurman K. Page

*Attorney, Agent, or Firm*—Gerald D. Sharkin; Richard E. Vila; Thomas C. Doyle

[57] ABSTRACT

Aqueous optical brightener compositions consisting essentially of:

(a) at least one optical brightener of formula in which $R_1$ is hydrogen or $—SO_3M$;

$R_2$ is hydrogen or $—SO_3M$;

$R_3$ is hydrogen, $C_{2-3}$-hydroxyalkyl, $C_{1-4}$-alkyl, $—CH_2—CH_2—CN$ or $—CH_2—CH_2—CONH_2$;

$R_4$ is hydrogen, $C_{1-4}$-alkyl, $C_{2-3}$-hydroxyalkyl, hydroxy-ethoxy-ethyl, N,N-Bis-($C_{1-3}$-alkyl)-amino-$C_{2-6}$-alkyl or benzyl;

or $R_3$ and $R_4$ together with the neighboring nitrogen atom signify a morpholine, pyrrolidine, piperidine or N-methylpiperazine ring;

and

M is hydrogen or a colorless cation; provided that at most one of $R_3$ and $R_4$ is hydrogen;

(b) polyethylene glycol with an average molecular weight in the range of 1000 to 3000;

and (c) water;

10 to 500 parts by weight of component (b) being present per 100 parts by weight of component (a), and component (c) constituting at least 20% of the composition, are storage stable optical brightener compositions, which are eminently suitable for the formulation of aqueous coating compositions especially such in which at least some of the binder is a synthetic latex; with these coating compositions there may be obtained very white coated papers which are optically brightened at least in the coating.

26 Claims, No Drawings

AQUEOUS OPTICAL BRIGHTENER COMPOSITIONS

The invention relates to aqueous optical brightener compositions consisting of a particular combination of optical brighteners and polyethylene glycols—optionally with additional base for pH-adjustment—in an aqueous medium, their use in the formulation and preparation of brightener-containing paper-coating compositions and the coating of paper with these brightener-containing coating compositions.

The invention thus provides aqueous optical brightener compositions consisting essentially of (a) at least one optical brightener of formula (I)

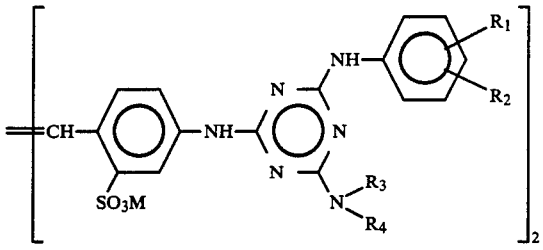

in which $R_1$ is hydrogen or $—SO_3M$, $R_2$ is hydrogen or $—SO_3M$, $R_3$ is hydrogen, $C_{2-3}$ hydroxyalkyl, $C_{1-4}$—alkyl, $—C_2—C_2—CN$ or $—CH_2—CH_2—CONH_2$, $R_4$ is hydrogen, $C_{1-4}$—alkyl, $C_{2-3}$—hydroxyalkyl, hydroxy—ethoxy—ethyl, di($C_{1-3}$—alkyl-)amino—$C_{2-6}$—alkyl or benzyl, or $R_3$ together with $R_4$ and the neighbouring nitrogen atom form a morpholine, pyrrolidine, piperidine or N-methylpiperazine ring, and M is hydrogen or a colourless cation, provided that at most one of $R_3$ and $R_4$ is hydrogen;

(b) a polyethylene glycol with an average molecular weight in the range of 1000 to 3000;

and (c) water;

in which 10 to 500 parts by weight of component (b) are present per 100 parts by weight of component (a), and (c) amounts to at least 20% by weight of the aqueous composition.

The compounds of formula (I) are known as such and also as optical brighteners. Preferred compounds of formula (I) are the ones in which $R_3$ signifies hydrogen, β-hydroxyethyl, β-hydroxypropyl, methyl, ethyl, β-cyanoethyl or β-carbamoylethyl and $R_4$ signifies β-hydroxyethyl, β-hydroxypropyl or β-(β'-hydroxyethoxy)-ethyl or $R_3$ and $R_4$ together with the neighbouring nitrogen atom signify a morpholine radical.

Component (a) may be divided into two subgroups:

($a_1$) Compounds of formula (I) in which $R_2$ is $—SO_3M$, of which those in which $R_1$ signifies hydrogen are preferred.

($a_2$) Compounds of formula (I) in which $R_1$ and $R_2$ both signify hydrogen.

If component (a) is a single optical brightener, this is preferably as defined under ($a_1$), $R_1$ being preferably hydrogen. If component (a) is a mixture of optical brighteners, this is preferably a mixture of components ($a_1$) and ($a_2$) as defined above, in which ($a_1$) may also be a mixture of optical brighteners, in which $R_1$ is hydrogen and in which $R_1$ is sulpho.

The weight ratio ($a_1$)/($a_2$) may range over a wide scope and depends in particular on the binders employed in the coating paste, substantially as described below.

The symbol M signifies preferably a colourless cation mainly alkali metal (in particular lithium, potassium or preferably sodium) or an ammonium cation, which may be unsubstituted or substituted by low molecular alkyl or alkanol radicals, preferably methyl, ethyl, β-hydroxyethyl and/or β-hydroxypropyl; preferred cations M are potassium, sodium, unsubstituted ammonium and mono-, di- or tri-ethanolammonium.

The optical brighteners of formula (I) employed as component (a) may contain up to 12% by weight of salt from their production, preferably they are, however, as salt-free as possible (as salts are meant here mainly inorganic salts, principally alkali metal salts and also amine salts, which may occur as secondary products during the production and isolation of the optical brightener); the compounds of formula (I) in which $R_1$ is hydrogen precipitate, upon their production in aqueous medium, by salting-out in the form of their alkali metal salts and are after filtration and washing sufficiently pure to be employed in the compositions of the invention; in the production of amine salts the free acid may be precipitated by acidification and may be reacted, after filtration and optionally washing with water, with the amine or with ammonia, yielding thus a very pure product. The compounds of formula (I) in which $R_1$ and $R_2$ are each a sulpho group are preferably dialysed in aqueous medium in the form of free acid or of the alkali metal salt and the free acid purified by dialysis may be neutralised with the corresponding base; in this way very pure products may be obtained. Preferably the components (a) do not contain more than 5% by weight of inorganic salts from the production.

The average molecular weight of the polyethylene glycol employed as the component (b) lies preferably in the range of 1000 to 2500, more preferably in the range of 1500 to 2500, particularly in the range of 1500 to 2200. As the polyethylene glycols (b) there may be used technical products as commercially available. The molecular weight of such a polyethylene glycol ranges in general in a relatively narrow scope in particular from ±5% to ±10% of the indicated main value, mainly from ±5% for polyethylene glycol 1000 to ±10% for polyethylene glycol 3000.

Preferably the weight ratio of component (b) to component (a) lies in the range of from 0.2:1 to 5.0:1. Preferably at least a part of component (a) is a component ($a_1$) as defined above and the weight ratio of component (b) to component ($a_1$) lies advantageously in the range of from 1.5:1 to 5.0:1, preferably in the range of 2.5:1 to 5.0:1, more preferably in the range of 3.0:1 to 4.0:1. If component (a) is a mixture of ($a_1$) and ($a_2$) the weight ratio of component (b) is referred only to component ($a_1$), component ($a_2$) being disregarded for this weight ratio.

The water content of the composition is suitably at least such that the composition is still stirrable and preferably well pourable; in concentrated compositions the concentration of component (a) is advantageously in the range of 5 to 30%, preferably 7 to 25% by weight of the composition, the water content being chosen preferably so that the dry content of the compositions is in the range of 10 to 80% by weight, more preferably in the range of 25 to 60% by weight; if as the component (a) there is employed exclusively ($a_1$) the dry content of the composition for concentrated compositions lies preferably in the range of 35 to 60% by weight.

The pH of the aqueous compositions is preferably from neutral to clearly alkaline, in particular in the range of from pH 7 to pH 10. The pH may, if necessary, be adjusted by addition of M-corresponding bases, e.g. alkali metal hydroxides or carbonates, ammonia or amines.

The optical brightener compositions of the invention are of notable stability to storage and may be used directly as such, i.e. they may be diluted with water and/or may be metered directly into the coating compositions. Thus a further object of the invention is the addition of the brightener compositions to paper-coating compositions in order to obtain a coated and optically brightened paper, at least the coating being optically brightened.

Thus, the invention provides also a process for the production of coated paper that is optically brightened at least in the coating, wherein a coating composition containing a brightener composition as described above is coated on paper after the sheet formation and fixed by thermal treatment.

The coating compositions are essentially aqueous compositions that contain at least one binder and optionally a white pigment, in particular an opacifying white pigment, and may additionally contain further usual assistants such as dispersing agents, iron-ion-binders, antifoaming agents etc.: the brightener compositions of the invention, which may if desired be diluted with water, are suitably added to these compositions during their formulation.

The binders may be any binders such as commonly used in the paper technique for the production of coating pastes and may consist of a single binder ($d_1$) or also of a mixture of primary ($d_1$) and secondary ($d_2$) binders. The sole or primary binder ($d_1$) is preferably a synthetic latex. The synthetic latices usable in coating pastes as sole or primary binding agents are in general known and exhaustively described in the specialized literature. Substantially they are polymers and copolymers of ethylenically unsaturated compounds, mainly the following: copolymers of butadiene and styrene, optionally containing additionally a carboxylated comonomer, polyacrylates, copolymers of alkyl acrylate and vinyl acetate containing optionally a carboxy group containing comonomer such as acrylic acid, itaconic acid or maleic acid and polyvinyl acetates that contain a carboxy group containing comonomer. Also the secondary binders ($d_2$) which may optionally be used together with the primary binders ($d_1$) are generally known and exhaustively described in the specialized literature; as most important representatives there may be mentioned: starch or casein (which may also be partially oxydized and/or hydrolyzed), modified cellulose, e.g. carboxymethyl cellulose and cellulose methylether, polyvinyl alcohol and low molecular carboxyl group containing polymers (in particular also polycarboxylic acid, e.g. copolymers of acrylic acid $C_{1-4}$-alkyl ester and acrylic acid which may additionally function as dispersing agents and as iron-ion-binders); of these are mainly preferred casein, the carboxy group containing polymers and polyvinyl alcohol. Together with the synthetic latices, there may be used common dispersing agents in addition to the polycarboxy compunds or in place of them in order to disperse the latices in water; preferably these common dispersing agents are nonionic emulsifiers. In general the synthetic binders are commercially available in the form of dispersions that optionally contain a dispersing agent (e.g. from the polymerisation reaction in aqueous dispersion).

Although it is also possible to produce coating compositions that are free from white pigments, it is in general preferred to produce and to apply coating compositions that contain white pigment, since paper coated with such pigmented coating compositions (in particular opaque coating compositions) are the ideal white substrate for good and clear printings. Such white pigments are substantially opacifying white pigments and are in general inorganic resp. mineral substances, mainly calcium carbonate, calcium sulphate (satin white) aluminium silicates and aluminium hydroxide, aluminium magnesium silicate (china clay) titanium dioxide or barium sulphate (blanc fix) and also mixtures of such pigments.

The white pigments and the further assistants that may optionally be present (e.g. dispersing agents, iron-ion binders, antifoaming agents etc.) are in general known in the art and described in the specialized literature.

There may be used any aqueous coating composition that contains a binder especially a synthetic binder and may contain further components, in particular a white pigment and optionally further assistants as indicated above. A particular object of the invention are brightener-containing aqueous paper-coating compositions, comprising (X) an aqueous brightener composition of the invention,
(D) a binder,
(E) water,
and
(F) a white pigment.

Component (D) comprises the whole binder-content, i.e. any primary binder ($d_1$) and, if present, also any secondary binder ($d_2$) and also the water contained in the latex (these latices are usually commercialised in water containing form and are mostly of a concentration of 40–70%). Component (E) represents the additional water required for the desired coating composition. Component (F) is in general any white pigment as usually employed in pigmented coating compositions, in particular for opacifying the coating composition and as described above.

The weight ratios of components (D), (E) and (F) correspond in general to those usual in coating compositions; furthermore the coating compositions may contain further known additives, e.g. antifoaming agents, buffer salts, bases, flow assistants etc. (see e.g. J. P. CASEY "Pulp and Paper, Chemistry and Chemical Technology", 2nd edition, Vol. III, pages 1646–1650). For every 100 parts by weight of white pigment there are employed preferably 5–20 parts by weight of synthetic latex ($d_1$) (calculated as an aqueous preparation of 50% concentration) and as much water (E) as corresponds to the desired dilution; the optical brightener (a) resp. the preparation (X) is added in such a concentration as required for the desired whitening effect; the optimum range of the degree of whiteness for a given coating composition may vary, depending on the kind of optical brightener and on the concentration and composition of the corresponding optical brightener preparation (X) and it may be determined by a few tests; the optimum optical brightener concentration lies in general advantageously in the range of 0.005 to 8.0 parts by weight, preferably—especially if component (a) consists only of component ($a_1$) without any component ($a_2$)—in the range of 0.05 to 4.0 parts by weight of the above-defined component (a) per 100 parts by weight of white pigment (as a reference).

If the brightener ($a_1$) is used without any admixture of ($a_2$) the content of secondary binder ($d_2$) is advantageously as low as possible; in this case the quantity of component ($d_2$) is preferably not above 1 part by weight per 100 parts by weight of white pigment.

If the binding agent (D) is a synthetic latex ($d_1$) without any admixture of ($d_2$) component (X) is preferably an optical brightener composition of the invention which contains as the component (a) only component ($a_1$) without any admixture of ($a_2$). If the binding agent (D) is a mixture of a synthetic latex ($d_1$) and a secondary binder or mixture of binders ($d_2$) there is used advantageously a composition (X) which contains component ($a_1$) in admixture with component ($a_2$); alternatively component ($a_1$) may be added in the form of an optical brightener composition of the invention and component ($a_2$) may be admixed as such or as an aqueous solution with the ($a_1$) containing brightener composition, prior to its addition to the coating composition or the ($a_1$) containig brightener composition and the brightener ($a_2$) (as such or as an aqueous solution) may be added separately to the coating composition; preferably components ($a_1$) and ($a_2$) are formulated together as an optical brightener composition of the invention and the whole is added to the coating composition during its formulation. If there is used a mixture of ($a_1$) and ($a_2$) when component (D) is a mixture of a synthetic latex ($d_1$) and a secondary binder ($d_2$) the optimum mixture ratio ($a_1$)/($a_2$) may vary widely depending on the composition of the binding agent (D); the weight ratio ($a_1$)-/($a_2$) lies e.g. in the range of 1:0.05 to 1:20, mainly in the range from 1:0.1 to 1:10; advantageously the weight ratio ($a_1$)/($a_2$) lies in the range of from 1:0.5 to 1:10 , preferably in the range of from 1:1 to 1:5.

The pH-value of the brightener-containing aqueous coating composition is preferably alkaline and may be adjusted with known bases (e.g. with alkali metal hydroxydes or carbonates or preferably with ammonia) to values preferably in the range of from 7.5 to 9, more preferably between 8 and 8.5.

The substrates for the coating compositions may be any kinds of paper as usually employed for coating, namely from the finest onion-skin paper up to heavy paper board and which may in general be produced from a large choice of cellulosic fibrous material, e.g. from wood fibres, mechanical pulp, annual plants, rags (of linen, hemp, cotton, jute etc.) or recycled paper. The paper to be coated may be unsized or sized. Occasionally also synthetic paper may be used as a substrate.

The new brightener-containing coating compositions may be applied on the paper by known methods with known apparatus (e.g. with a rod, with brushes, with a blade or with an air knife). The coating may be carried out in a discontinuous or in a continuous way, in particular during the continuous high-speed production of paper. The fixation of the optical brightener-containing coating takes place by heating, suitably during the normal drying step (e.g. in a temperature range between 50° and 120° C., preferably 65° and 95° C.).

According to the invention there may be obtained optically brightened and coated papers with optimum whiteness and high whiteness-yield and there may be obtained very homogeneous coatings, especially under continuous coating conditions and at high coating speeds. If desired, the coated paper may be after-treated to obtain a particular gloss. The resulting coated papers are eminently suitable for good and clear printings with a clean and sharp outline.

In the following examples parts and percentages are by weight:, the temperatures are indicated in degrees Celsius. The numbering of the optical brighteners indicated in the examples corresponds to that of table 1.

EXAMPLE 1

The optical brightener compositions 1 to 24 are produced as follows:

10 parts of an optical brightener of formula (II) below
35 parts of polyethylene glycol 2000
55 parts of water are admixed in a glass beaker with a magnetic stirrer while heating up to 60°–80°, until there is obtained a yellowish clear blue-fluorescing solution that remains stable upon cooling to room temperature. The pH of the composition is adjusted to 9.0 with the base corresponding to M. (sodium hydroxide, potassium hydroxide, ammonia or amine).

In the following table 1 are enumerated the compositions 1 to 24 which are characterized by the optical brightener of formula

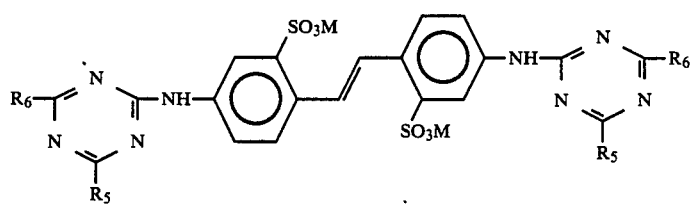

(II)

resp. by the significances of the symbols $R_5$, $R_6$ and M:

TABLE 1

| Composition nr. (= brightener nr.) | $R_5$ | $R_6$ | M |
|---|---|---|---|
| (1) | 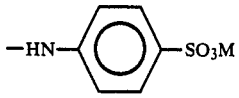 | $-N(CH_2CH_2OH)_2$ | $Na/H_3NCH_2CH_2OH$ |

TABLE 1-continued
| Composition nr. (= brightener nr.) | $R_5$ | $R_6$ | M |
|---|---|---|---|
| (2) | 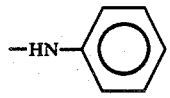 | $-N(CH_2CH_2OH)_2$ | $H_3NCH_2CH_2OH$ |
| (3) | 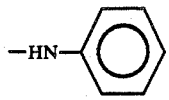 | 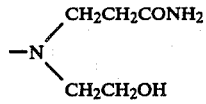 | $HN(CH_2CH_2OH)_3$ |
| (4) | 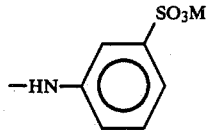 | $-HNCH_2CH_2OH$ | $Na/NH_4$ |
| (5) | 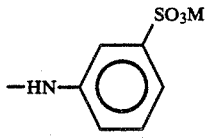 | $-N(CH_2CH_2OH)_2$ | $Na/H_3NCH_2CH_2OH$ |
| (6) | 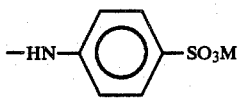 | 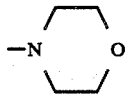 | Na |
| (7) | 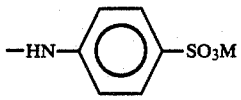 | $-HNCH_2CH_2OH$ | Na/K |
| (8) | 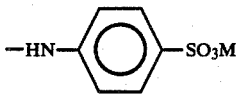 | 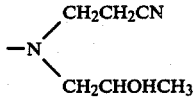 | Na |
| (9) | 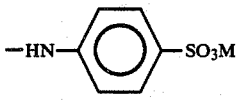 | 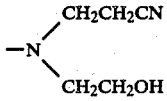 | Na |
| (10) | 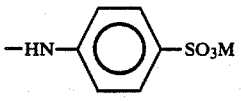 | 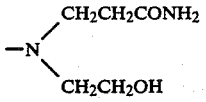 | Na |
| (11) | 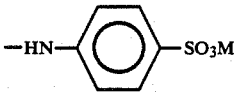 | $-HNCH_2CH_2OCH_2CH_2OH$ | Na |
| (12) | 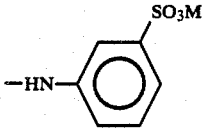 | 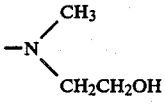 | K |
| (13) | 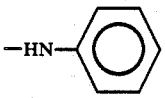 | $-HNCH_2CH_2OH$ | $H_3NCH_2CH_2OH$ |

TABLE 1-continued
| Composition nr. (= brightener nr.) | $R_5$ | $R_6$ | M |
|---|---|---|---|
| (14) | 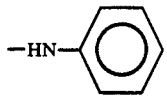 | 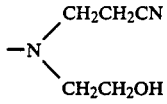 | $NH_4$ |
| (15) | 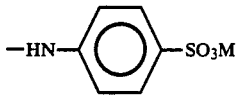 | $-N(CH_2CHOHCH_3)_2$ | Na/K |
| (16) | 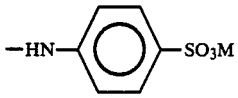 | $-HNCH_2CHOHCH_3$ | K |
| (17) | 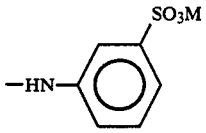 | $-N(CH_2CHOHCH_3)_2$ | $Na/H_3NCH_2CH_2OH$ |
| (18) | 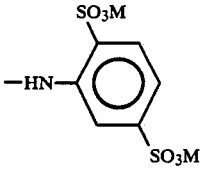 | $-N(CH_2CH_2OH)_2$ | Na |
| (19) | 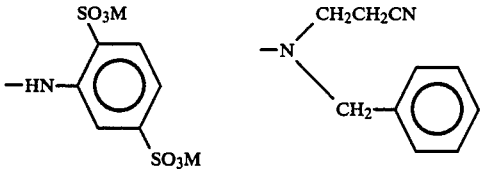 | | Na |
| (20) | 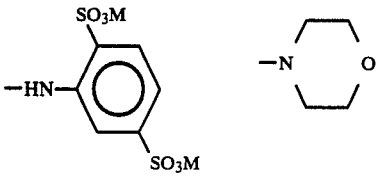 | | Na |
| (21) | 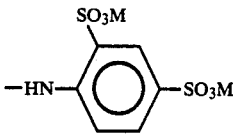 | $-N(CH_2CH_3)_2$ | Na |
| (22) | 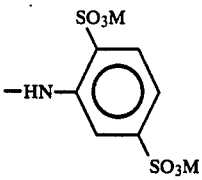 | $-N(CH_2CH_3)_2$ | Na |
| (23) | 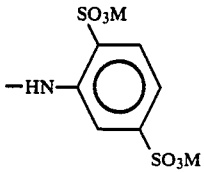 | | Na |

TABLE 1-continued

| Composition nr. (= brightener nr.) | $R_5$ | $R_6$ | M |
|---|---|---|---|
| (24) | 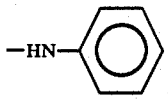 | $-N(CH_2-CH_2-CN)(CH_2-CHOH-CH_3)$ | $HN(CH_2-CH_2OH)_3$ |

EXAMPLE 2

12 parts of the monoethanolammonium salt of the optical brightener (1)
26 parts of polyethylenegylcol 3000 and
52 parts of water
are admixed in a glass beaker at 60°-80° with stirring; when a clear solution has formed there are added
25 parts of an aqueous 35% solution of the monoethanolammonium salt of the optical brightener (2)
with stirring. The mixture is cooled to room temperature and is a brownish clear blue-fluorescing solution. The pH ist adjusted to 9.0 with monoethanolamine.

In the following table 2 there are enumerated further optical brightener preparations that are obtained as described in example 2, the employed optical brighteners being indicated in columns 2 and 3 and their quantities in columns 4 and 5.

TABLE 2

| Example nr. | Brightener nr. ($a_1$) | Brightener nr. ($a_2$) | parts by weight ($a_1$) | parts by weight ($a_2$) |
|---|---|---|---|---|
| 2a | 4 | 3 | 12 | 5 |
| 2b | 6 | 13 | 12 | 2 |
| 2c | 7 | 14 | 12 | 10 |
| 2d | 8 | 24 | 12 | 8 |
| 2e | 9 | 3 | 12 | 5 |
| 2f | 15 | 14 | 12 | 2 |
| 2g | 18 | 13 | 12 | 1 |
| 2h | 19 | 2 | 12 | 7 |
| 2i | 20 | 24 | 12 | 9 |
| 2k | 23 | 3 | 12 | 4 |

EXAMPLE 3

10 parts of the sodium salt of the optical brightener (10)
30 parts of polyethyleneglycol 1500 and
60 parts of water
are admixed until a solution is formed analogously as described in example 2. Then
300 parts of an aqueous 30% solution of the triethanolammonium salt of the optical brightener (3)
are added and a clear brownish solution is obtained, the pH of which is adjusted to 9.0 with sodium hydroxide.

In the following table 3 there are enumerated further optical brightener preparations obtained as described in example 3 but using the optical brighteners ($a_1$) and ($a_2$) indicated in table 3; the quantities of the optical brighteners are indicated in columns 4 and 5.

TABLE 3

| Example nr. | Brightener nr. ($a_1$) | Brightener nr. ($a_2$) | parts by weight ($a_1$) | parts by weight ($a_2$) |
|---|---|---|---|---|
| 3a | 1 | 3 | 10 | 20 |
| 3b | 5 | 2 | 10 | 50 |
| 3c | 9 | 24 | 10 | 10 |
| 3d | 11 | 14 | 10 | 5 |
| 3e | 12 | 13 | 10 | 70 |
| 3f | 16 | 3 | 10 | 2 |
| 3g | 22 | 2 | 10 | 10 |

EXAMPLE 4

15 parts of the optical brightener (8)
40 parts of polyethyleneglycol 2000
55 parts of water
are dissolved in the same way as described in example 2, then
100 parts of an aqueous 20% solution of the optical brightener (24)
are added with stirring. Upon cooling to room temperature there is obtained a clear brownish strongly fluorescing solution, the pH of which is adjusted to 9.0 with sodium hydroxide.

In the following table 4 there are enumerated further optical brightener compositions obtained as indicated in example 4 but employing the optical brighteners ($a_1$) and ($a_2$) indicated in table 4 and in the there indicated quantities.

TABLE 4

| Example nr. | Brightener nr. ($a_1$) | Brightener nr. ($a_2$) | parts by weight ($a_1$) | parts by weight ($a_2$ |
|---|---|---|---|---|
| 4a | 9 | 24 | 15 | 85 |
| 4b | 4 | 2 | 15 | 10 |
| 4c | 6 | 3 | 15 | 150 |
| 4d | 10 | 13 | 15 | 30 |
| 4e | 8 | 14 | 15 | 75 |
| 4f | 15 | 2 | 15 | 45 |
| 4g | 18 | 24 | 15 | 20 |
| 4h | 12 | 13 | 15 | 50 |
| 4i | 19 | 3 | 15 | 15 |
| 4k | 23 | 2 | 15 | 7 |

EXAMPLE A

The pH of a coating composition formulated of
100 parts of kaolin (China clay SPS).
0,4 part of Polysalt F [sodium salt of a polycrylic acid (BASF)]
10 parts of Dow Latex 620 (50% dispersion of a butadiene-styrene-copolymerisate of DOW CHEMICAL)
with a solid content of 60%, is adjusted to pH 8.5 with ammonia. Then, the optical brightener composition no. 23 is admixed to different samples of this composition in concentrations of from 1% up to 8% (referred to the content of kaolin).

The so-obtained coating compositions containing different concentrations of the optical brightener composition are coated with a roller coater on the felt-side of coating raw stock in a quantity of 20 g/m$^2$ and then dried at 90°-95° with a warm air dryer during 1 minute.

In comparison with papers coated with a composition containing no optical brightener preparation the so-obtained optically brightened coated papers have a clearly improved whiteness.

Depending on the physical properties required for the coating, the coating composition may also contain different quantities of the butadiene-styrene copolymerisate, e.g. increased or diminished by 20%.

Also under these modified conditions there is obtained a clear increment of the whiteness.

Analogously as described in example A there are employed the optical brightener compositions (1) to (22) or (24) by which there are also obtained highly white coated papers.

EXAMPLE B

Example A is repeated but in place of the butadiene-styrene-copolymerisate there is used Acronal S 320 D (50% aqueous dispersion of a mixed polymer of acrylic acid ester and styrene of BASF). Coated paper of high-whiteness is obtained.

EXAMPLES C

Example A is repeated but the following coating compositions are employed in place of the coating composition used in Example A:

EXAMPLE C1

Into a composition of the following formulation:
100 parts of kaolin (China clay SPS)
0.3 parts of Polysalt F (BASF)
0.1 parts of sodium hydroxide
8 parts of starch
24 parts of Acronal S 320 D (BASF)
with a solid content of 60% are admixed in different samples 1 to 8 parts of the optical brightener composition of example 2.

Papers coated with these coatings are of high whiteness.

In an analogous way the optical brightener compositions of examples 2a to 2k are employed in place of the optical brightener composition of example 2.

EXAMPLE C2

Coating composition:
90 parts of kaolin (China clay SPS)
10 parts of calcium carbonate
0.3 parts of Polysalt F (BASF)
0.25 parts of sodium hydroxide
5 parts of caseine (dissolved with sodium hydroxide/ammonia)
20 parts of Acronal S 320 D (BASF)
1–8 parts of the optical brightner composition of example 3; solid content 55%.

Paper coated with these coating compositions are of high whiteness.

The optical brightener compositions of the example 3a to 3g are employed in an analogous way in place of the optical brightener composition of example 3.

EXAMPLE C3

The method of example C1 is followed, using in place of the optical brightener composition of example 2 the one of example 4. There is obtained a very good whiteness. In place of the composition of example 4 the ones of examples 4a to 4k may be employed.

EXAMPLE C4

The procedure of example C2 is followed, using in place of the optical brightener composition of example 3 the one of example 4. There is obtained a very high whiteness. In place of the composition of example 4 there may be used the ones of examples 4a to 4k.

What is claimed is:

1. An aqueous optical brightener composition consisting essentially of:

(a) at least one optical brightener of formula (I)

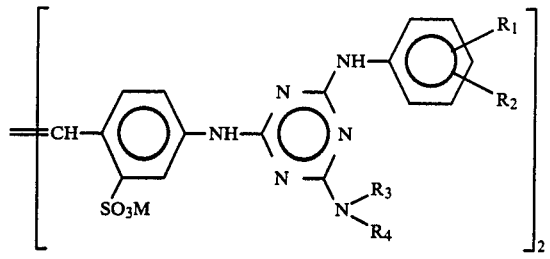

in which
$R_1$ is hydrogen or $—SO_3M$;
$R_2$ is hydrogen or $—SO_3M$;
$R_3$ is hydrogen, $C_{2-3}$—hydroxyalkyl, $C_{1-4}$—alkyl, $—CH_2—CH_2—CN$ or $—CH_2—CH_2—CONH_2$;
$R_4$ is hydrogen, $C_{1-4}$—alkyl, $C_{2-3}$—hydroxyalkyl, hydroxy—ethoxyethyl, N,N-Bis-($C_{1-3}$—alkyl-)—amino—$C_{2-6}$—alkyl or benzyl;
or
$R_3$ and $R_4$ together with the nitrogen atom to which they are attached signify a morpholine, pyrrolidine, piperidine or N-methylpiperazine ring;
and
M is hydrogen or a colourless cation;
provided that at most one of $R_3$ and $R_4$ is hydrogen;
(b) polyethylene glycol with an average molecular weight in the range of 1000 to 3000;
and
(c) water;
component (a) being selected from the group consisting of ($a_1$) compounds of formula (I) in which $R_2$ is $—SO_3M$, ($a_2$) compounds of formula (I) in which $R_1$ and $R_2$ are both hydrogen, and mixtures of ($a_1$) and ($a_2$),
component (b) being present in an amount of 10 to 500 parts by weight per 100 parts by weight ($a_1$) when (a) comprises only ($a_1$) or a mixture of ($a_1$) and ($a_2$) and in an amount of 10 to 500 parts by weight per 100 parts by weight ($a_2$) when (a) comprises only ($a_2$), and
component (c) being present in an amount of at least 20% by weight of the aqueous composition.

2. An aqueous optical brightener composition consisting essentially of:

(a) at least one optical brightener of formula (I)

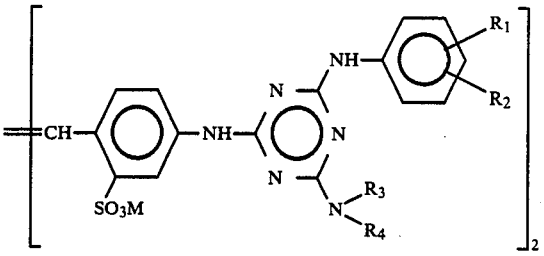

in which
$R_1$ is hydrogen or $—SO_3M$;
$R_2$ is hydrogen or $—SO_3M$;
$R_3$ is hydrogen, $C_{2-3}$—hydroxyalkyl, $C_{1-4}$—alkyl, $—CH_2—CH_2—CN$ or $—CH_2——CH_2—CONH_2$;

$R_4$ is hydrogen, $C_{1-4}$—alkyl, $C_{2-3}$—hydroxyalkyl, hydroxy—ethoxy ethyl, N,N,-Bis-($C_{1-3}$—alkyl)—amino—$C_{2-6}$—alkyl or benzyl;

or $R_3$ and $R_4$ together with the nitrogen atom to which they are attached signify a morpholine, pyrrolidine, piperdine or N-methylpiperazine ring;

M is hydrogen or a colourless cation;

provided that at most one of $R_3$ and $R_4$ is hydrogen;

(b) polyethylene glycol with an average molecular weight in the range of 1000 to 3000;

and (c) water;

component (a) being selected from the group consisting of ($a_1$) compounds of formula (I) in which $R_2$ is —$SO_3M$ and mixtures of ($a_1$) and ($a_2$) compounds of formula (I) in which $R_1$ and $R_2$ are both hydrogen, component (b) being present in an amount of 10 to 500 parts by weight per 100 parts by weight of ($a_1$) and component (c) being present in an amount of at least 20% by weight of the aqueous composition.

3. A composition according to claim 2 wherein (a) is a single optical brightener ($a_1$) of formula (I) in which $R_2$ is —$SO_3M$.

4. A composition according to claim 2 wherein (a) is a single optical brightener ($a_1$) of formula (I) in which $R_1$ is hydrogen and $R_2$ is —$SO_3M$.

5. A composition according to claim 2 wherein (a) is a mixture of at least one optical brightener ($a_1$) of formula (I) in which $R_2$ is —$SO_3M$ and ($a_2$) an optical brightener of formula (I) in which $R_1$ and $R_2$ are both hydrogen.

6. A composition according to claim 5 in which the weight ratio ($a_1$):($a_2$) is in the range of 1:0.5 to 1:10.

7. A composition according to claim 2 in which the weight ratio (b):($a_1$) lies in the range of 1.1:5 to 5.1.

8. A composition according to claim 5 in which the weight ratio (b):($a_1$) lies in the range of 1.1:5 to 5.1.

9. A concentrated aqueous composition according to claim 1 in which (a) amounts to 5 to 30% by weight of the composition.

10. An aqueous composition according to claim 1, the pH of which is in the range of 7 to 10.

11. A composition according to claim 1 wherein, in formula (I), $R_3$ is hydrogen, β-hydroxyethyl, β-hydroxypropyl, methyl, ethyl, β-cyanoethyl or β-carbamoylethyl, $R_4$ is β-hydroxyethyl, β-hydroxypropyl or β-(β'-hydroxyethoxy)-ethyl, or $R_3$ and $R_4$ together with the nitrogen atom to which they are attached form a morpholine radical, and M is sodium, potassium, lithium, unsubstituted ammonium or ammonium mono-, di- or tri-substituted by methyl, ethyl, β-hydroxyethyl and/or β-hydroxypropyl.

12. A composition according to claim 1 in which (b) is a polyethyleneglycol of average molecular weight in the range of 1000 to 2500.

13. A composition according to claim 2 wherein, in formula (I), $R_3$ is hydrogen, β-hydroxyethyl, β-hydroxypropyl, methyl, ethyl, β-cyanoethyl or β-carbamoylethyl, $R_4$ is β-hydroxyethyl, β-hydroxypropyl or β-(β'-hydroxyethoxy)-ethyl, or $R_3$ and $R_4$ together with the nitrogen atom to which they are attached form a morpholine radical, and M is sodium, potassium, lithium, unsubstituted ammonium or ammonium mono-, di- or tri-substituted by methyl, ethyl, β-hydroxyethyl and/or β-hydroxypropyl.

14. A composition according to claim 9 in which (b) is a polyethylene glycol of average molecular weight in the range 1000 to 2500.

15. A composition according to claim 2 in which (a) amounts to 5 to 30% by weight of the composition.

16. A composition according to claim 2 having a pH in the range 7 to 10.

17. A composition according to claim 3 in which the weight ratio (b):($a_1$) is in the range 1.5:1 to 5:1.

18. A composition according to claim 4 in which the weight ratio (b):($a_1$) is in the range 2.5:1 to 5:1.

19. A composition according to claim 6 in which the weight ratio (b):($a_1$) is in the range 1.5:1 to 5:1.

20. A composition according to claim 8 in which the weight ratio (b):($a_1$) is in the range 3.0:1 to 4.0:1.

21. A composition according to claim 5 in which (b) is a polyethylene glycol of average molecular weight in the range 1000 to 2500, the amount of (a) is 5 to 30% by weight of the composition and the pH is in the range 7 to 10.

22. A composition according to claim 18 in which (b) is a polyethylene glycol of average molecular weight in the range 1000 to 2500, the amount of ($a_1$) is 5 to 30% by weight of the composition and the pH is in the range 7 to 10.

23. A composition according to claim 20 in which (b) is a polyethylene glycol of average molecular weight in the range 1000 to 2500, the amount of ($a_1$) is 5 to 30% by weight of the composition and the pH is in the range 7 to 10.

24. A composition according to claim 23 wherein, in formula (I), $R_3$ is hydrogen, β-hydroxyethyl, β-hydroxypropyl, methyl, ethyl, β-cyanoethyl or β-carbamoylethyl, $R_4$ is β-hydroxyethyl, β-hydroxypropyl or β-(β'-hydroxyethoxy)-ethyl, or $R_3$ and $R_4$ together with the nitrogen atom to which they are attached form a morpholine radical, and M is sodium, potassium, lithium, unsubstituted ammonium or ammonium mono-, di- or tri-substituted by methyl, ethyl, β-hydroxyethyl and/or β-hydroxypropyl.

25. A composition according to claim 12 having a pH in the range 7 to 10 and containing 5 to 30%, by weight, of (a).

26. A composition according to claim 22 wherein, in formula (I), $R_3$ is hydrogen, β-hydroxyethyl, β-hydroxypropyl, methyl, ethyl, β-cyanoethyl or β-carbamoylethyl, $R_4$ is β-hydroxyethyl, β-hydroxypropyl or β-(β'-hydroxyethoxy)-ethyl, or $R_3$ and $R_4$ together with the nitrogen atom to which they are attached form a morpholine radical, and M is sodium, potassium, lithium, unsubstituted ammonium or ammonium mono-, di- or tri-substituted by methyl, ethyl, β-hydroxyethyl and/or β-hydroxypropyl.

* * * * *